United States Patent [19]

Boudouris

[11] 3,988,626

[45] Oct. 26, 1976

[54] MAGNETICALLY STABILIZED XENON ARC LAMP

[75] Inventor: Angelo Boudouris, Sylvania, Ohio

[73] Assignee: Eprad Incorporated, Toledo, Ohio

[22] Filed: May 12, 1975

[21] Appl. No.: 576,378

[52] U.S. Cl. ..... 313/113; 313/161; 313/184; 313/224

[51] Int. Cl.[2] ..... H01J 1/50; H01J 61/16

[58] Field of Search ..... 313/184, 161, 113, 224, 313/156; 315/344

[56] References Cited

UNITED STATES PATENTS

| | | | |
|---|---|---|---|
| 3,562,583 | 2/1971 | Zollweg et al. | 313/156 X |
| 3,706,000 | 12/1972 | Retzer et al. | 313/184 X |
| 3,827,782 | 8/1974 | Boudouris et al. | 350/293 X |

*Primary Examiner*—Palmer C. Demeo
*Attorney, Agent, or Firm*—Oliver E. Todd, Jr.

[57] ABSTRACT

An improved lamphousing having a magnetically stabilized arc lamp. The arc lamp, such as a high-pressure short-arc xenon lamp, is mounted within the lamphousing such that the arc is positioned at the focal point of a reflector formed from a paramagnetic material. One or more permanent magnets are mounted on the exterior of the reflector to establish a magnetic flux within the reflector which stabilizes the plasma flame sufficiently to permit horizontal operation of the arc lamp at any current levels especially below the rated level for that arc lamp.

5 Claims, 2 Drawing Figures

MAGNETICALLY STABILIZED XENON ARC LAMP

BACKGROUND OF THE INVENTION

This invention relates to light projectors and more particularly to a lamphousing including improved apparatus for magnetically stabilizing the arc in a horizontally operated high-pressure short-arc xenon lamp.

In recent years, carbon arc light sources for light projectors such as are used with motion picture projectors and for theatrical stage lighting have often been replaced with gaseous discharge lamps, such as the high-pressure short-arc xenon lamp, mounted in a lamphousing. Lamps of this type are not only more efficient than carbon arc lamps, but they can also produce a whiter light. In early projectors using short-arc xenon lamps, it was necessary to orient the lamp with the electrodes vertically aligned and the larger anodes spaced above the smaller cathode. This lamp orientation is inefficient since the collecting mirror cannot effectively collect the light being generated 360° around the arc light source. It is preferable to operate the lamp in a horizontal orientation since considerably more light can be collected and distributed properly across the film aperture plate. However, if the lamp is tipped from a vertical electrode orientation, convection currents within the gas in the lamp envelope cause the arc to rise and also cause the projected light to flicker or move about. This in turn causes the electrodes to wear at an uneven rate. More importantly, a hot spot occurs on the portion of the lamp envelope above the arc or plasma flame surrounding the arc which greatly increased the rate at which the lamp envelope devitrifies. If the plasma flame actually touches the envelope, the envelope softens or melts to a point where the high internal gas pressures cause the lamp to shatter.

Three methods are known for stabilizing the arc or plasma flame in a xenon lamp to permit operating the lamp with the electrodes in a horizontal orientation. By operating the lamp at a very intense current level, self-magnetism causes the plasma to be "stiff" and stay substantially centered between the electrodes. However, the very high currents are inefficient and decrease the lamp life. When a lamp manufacturer specifies that a lamp may be operated in a horizontal orientation, the lamp has a high current rating. Typically, the lamp must be operated at at least 80% of its rated current when horizontal. There is a high risk of destruction of the bulb if the lamp current is substantially decreased below the rated current.

Another method for stabilizing the arc is disclosed in U.S. Pat. No. 2,757,277 which issued on July 31, 1956. Here, the lamp is mounted on a support which is continuously rotated to prevent overheating the top of the lamp envelope. However, the lamp support is complicated and would not be practical for many installations.

U.S. Pat. No. 2,757,277 also indicates that the lamp may be stabilized with a magnetic field-producing device. However, it is pointed out that the magnetic field-producing devices needed to be located in areas where they obstructed useful light produced by the lamp. Such an arrangement is shown in U.S. Pat. No. 3,624,386, which issued on Nov. 30, 1971. This patent discloses a lamphousing in which the horizontal cathode of an arc lamp passes through an opening in the center of a reflector in a conventional manner. Either a permanent magnet or an electromagnet is mounted below the lamp on an adjustable bracket for arc stabilization. However, the magnet is also located below the arc plasma in the region between the reflector and a light outlet port on the lamphousing. Therefore, a portion of the useful reflected light is lost. Generally, lamphousings having magnetic arc stabilization have also used expensive glass reflectors since metallic reflectors would have interfered with the magnetic field and therefore interfered with the arc stabilization. Another problem encountered in lamphousings of this type has been with initial magnet adjustment. Since the magnet is located within the reflector, an operator is exposed to the hot lamp while initially adjusting or locating the magnet and he is also exposed to injury if the lamp should explode.

SUMMARY OF THE INVENTION

According to the present invention, an improved magnetic stabilizing means permits the operation of a high-pressure short-arc xenon lamp in a horizontal orientation in a lamphousing. The lamp is mounted horizontally within a light reflector such that the arc or fireball is positioned substantially at the focal point of the reflector. The reflector is formed from a paramagnetic material such as nickel. The reflector may be formed, for example, by electrodepositing a thick layer of the paramagnetic material upon a shaped form and subsequently separating the deposited material from the form. The brightness of the interior reflecting surface may subsequently be increased by polishing or by vacuum depositing aluminum or some other highly reflective metal onto the surface.

According to this invention, the arc or fireball and surrounding plasma is magnetically stabilized by attaching one or more permanent magnets to the exterior of the paramagnetic reflector. Since the reflector is of a paramagnetic material, the permanent magnet magnetizes the adjacent portion of the reflector. The permanent magnet is located at a preselected position on the reflector and the magnetic poles are oriented such that the established magnetic field stabilizes the arc and surrounding plasma to prevent flicker or variations of the reflected light and also to prevent the plasma from rising and touching the lamp envelope. Since the magnet is located exterior to the reflector, an operator may initially position the magnet on the reflector while the lamp is operating. If the lamp should explode while the magnet is being located on the reflector, the reflector protects the operator from the explosion. Once the location and orientation for the magnet is determined, the magnet is attached to the outside of the reflector by a suitable glue or adhesive material, such as an epoxy resin. Since the focal point of the reflector does not change, it is not necessary to reposition the magnet when the lamp is changed. It will also be noted that since the magnet is located on the exterior of the reflector, it does not interfere with or distort the reflected light pattern.

Accordingly, it is an object of the invention to provide an improved apparatus for magnetically stabilizing a horizontally operated arc lamp.

Another object of the invention is to provide an improved apparatus for magnetically stabilizing the arc and surrounding plasma in a high-pressure short-arc xenon lamp while operated in a horizontal position.

Other objects and advantages of the invention will become apparent from the following detailed description, with reference being made to the accompanying drawings.

DESCRIPTION OF A PREFERRED EMBODIMENT

Quartz enclosed high-intensity light arc lamps are now in common use in motion picture theaters as light sources for motion picture projectors and in performing art theaters for stage lighting. Light sources of this type generally include an air-cooled lamphousing in which is mounted a high-intensity arc lamp, such as a high-pressure short-arc xenon lamp. A glass mirror or a highly polished metal reflector is mounted to direct the light from the lamp through an opening in the lamphousing to, for example, a motion picture projector or a stage. An infrared filter or reflector is often positioned adjacent the lamphousing opening to filter out or redirect infrared radiation while passing visible light. Cooling air is circulated through the lamphousing to remove heat from the lamp, the reflector and the filter. A typical lamphousing of this type is disclosed in U.S. Pat. No. 3,827,782 which issued on Aug. 6, 1974 to Angelo Boudouris et al, and the disclosure of such patent is incorporated herein.

Figure 1:
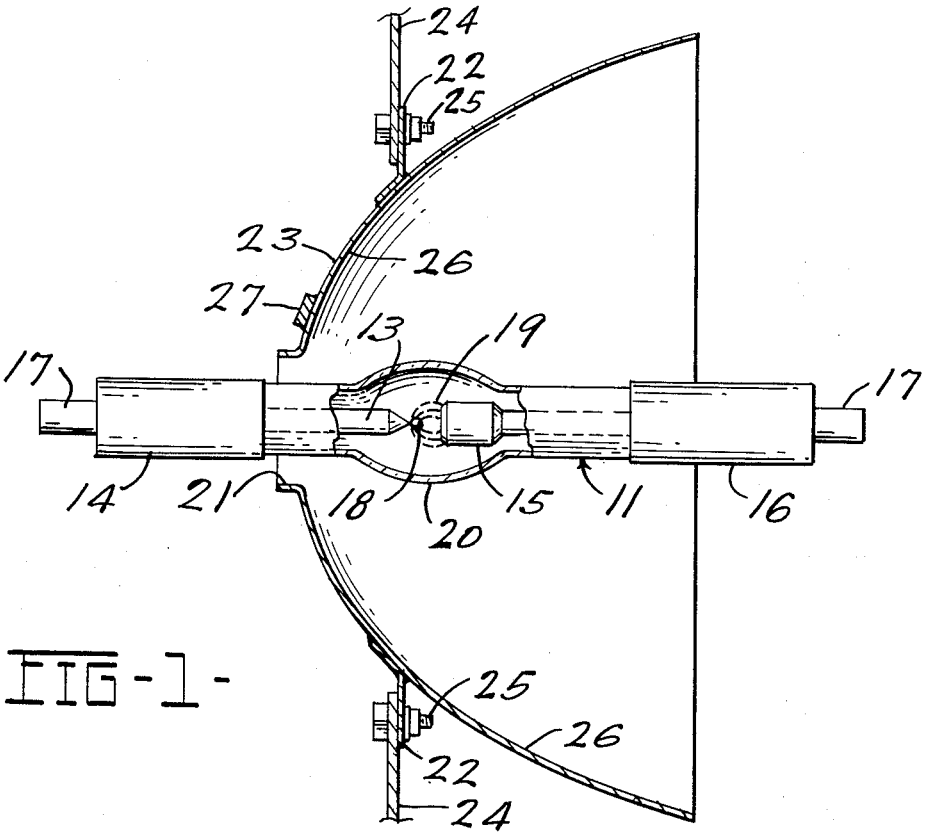
FIG. 1 shows a fragmentary, elevational, cross section of a light reflector and magnetically stabilized high-pressure short-arc xenon lamp constructed in accordance with the present invention.
Figure 2:
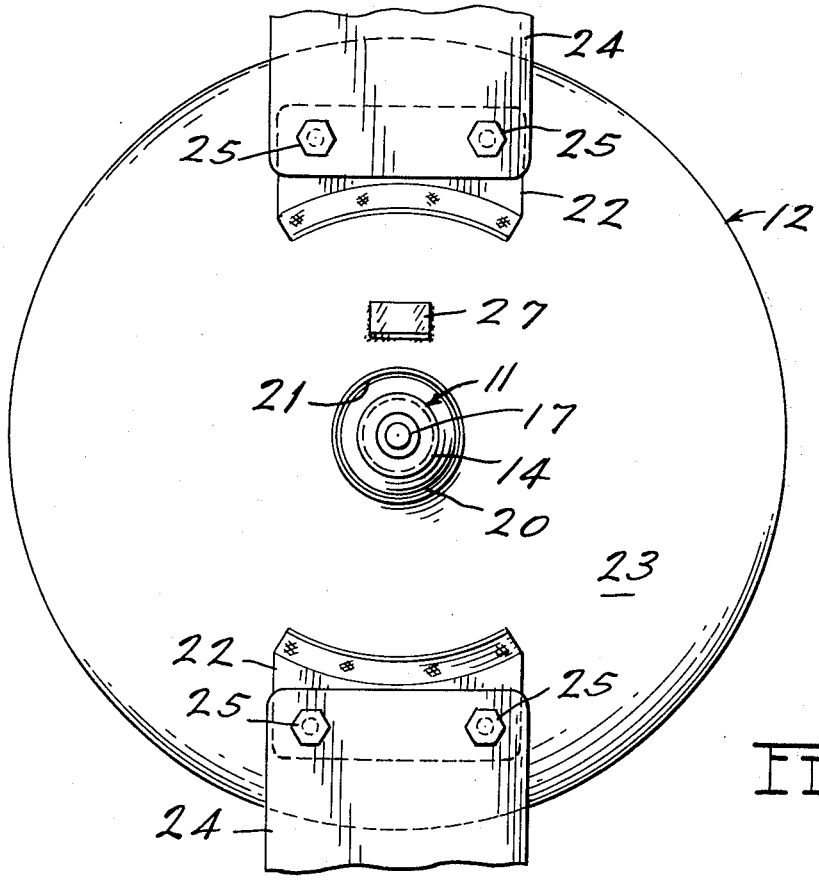
FIG. 2 is a rear elevational view of the reflector and lamp of FIG. 1.

Turning now to the drawings, FIG. 1 shows a fragmentary, elevational cross section of a lamp 11 and a reflector 12 within a portion of a lamphousing such as the housing shown in the referenced U.S. Pat. No. 3,827,782 and FIG. 2 shows a rear elevational view of the reflector 12. The lamp 11 is a high-pressure short-arc xenon lamp which produces a white light. The lamp 11 is shown positioned within the reflector 12 which is of a deep dish shape. The lamp 11 includes a pointed cathode 13 connected to a terminal 14 and a relatively massive anode 15 connected to a terminal 16. Extending from the terminals 14 and 16 are support brackets 17 for use in mounting the lamp 11 in a conventional manner.

In operation, a typical xenon lamp requires low-voltage DC currents at relatively high current level. For example, a typical 1600-watt lamp may require 25 volts DC at 65 amperes for rated operation. However, the low-voltage is inadequate for starting the lamp. The lamp 11 is connected to a suitable power supply and starting circuit (not shown) which initially applies a higher than normal DC voltage between the cathode 13 and the anode 15. For example, the lamp may require 70 to 100 volts DC during starting. Also, a radio frequency starting signal is superimposed upon the higher DC voltage for initially striking the arc. After the arc is struck, the higher level DC voltage sustains the arc while heating the gas within the lamp 11. As the gas heats, the current level increases and the voltage decreases until the final operating conditions are obtained. When the lamp 11 reaches its final operating condition, a fireball or arc 18, typically on the order of only a few millimeters in diameter, exists between the cathode 13 and the anode 15. In the immediate region surrounding the fireball 18, there is a plasma 19 of hot, ionized xenon gas. If the cathode 13 and anode 15 are oriented horizontally, as shown in the drawings, the plasma 19 will tend to rise due to convection currents within the xenon gas. Under severe conditions or when the lamp 11 is operated below its rated current to extend its life, the plasma 19 may rise sufficiently to touch the envelope 20 of the lamp 11 immediately above the fireball 18. If this happens, the lamp 11 will destruct due to the high gas pressures within the lamp 11. Therefore, it is necessary to stabilize the fireball 18 and plasma 19 to permit safe operation of the lamp 11 in a horizontal orientation at below the rated current.

The reflector 12 surrounds the lamp 11 and is oriented with respect to the lamp 11 such that the fireball 18 is at or near the focal point of the reflector 12. The reflector 12 is generally elliptical for film projection, parabolic for spot lights, and includes an opening 21 at its vertex through which the portion of the lamp 11 connecting the cathode 13 to the terminal 14 extends. The reflector 12 is shaped to direct light generated by the fireball 18 within the lamp 11 through an opening (not shown) within the lamphousing towards either a film gate within a projector or towards a stage or other area being illuminated.

The reflector 12 is mounted within the lamphousing by conventional means. For example, mounting brackets 22 may be cemented or otherwise attached to an exterior surface 23 on the reflector 12. The brackets 22 are then attached to support members within the lamphousing, such as a bulkhead 24 by means of bolts 25. Normally, either the bulkhead 24 or other mounting means for the reflector 12 is adjustable with respect to the lamp 11 or the mounting for the lamp 11 is adjustable with respect to the reflector 12 to permit locating the fireball 18 at or near the focal point for the reflector 12 when bulbs are changed or different size bulbs are used with the reflector 12. A typical adjustable mount for the reflector 12 is shown in the referenced U.S. Pat. No. 3,827,782.

The reflector 12 is formed from a paramagnetic material such as nickel. The reflector 12 may be formed by any suitable method. One method for forming the reflector 12 is to electro-deposit a layer of nickel on a form having the shape of the interior of the reflector 12. The electrodeposited nickel reflector 12 is then separated from the form. The interior surface 26 of the reflector 12 may then be provided with a highly reflective coating, such as a vacuum deposited aluminum coating, or less reflective rhodium. The coating must be of such a nature as not to interfere with magnetically stabilizing the plasma 19 and fireball 18 within the lamp 11 and is preferably non-magnetic.

The fireball 18 and plasma 19 are stabilized by means of a permanent magnet 27 attached to the exterior surface 23 of the reflector 12. The magnet 27 is shown positioned above the lamp 11 immediately adjacent the reflector opening 21. The magnet 27 is attached to the reflector 12 by a suitable bonding agent, such as an epoxy resin. When the magnet 27 is positioned against the exterior surface 23 of the reflector 12, the adjacent portion of the reflector 12 becomes magnetized since the reflector is of a paramagnetic material. The resulting field within the reflector 12 must be of such an orientation that the fireball 18 and plasma 19 within the lamp 11 are stabilized. For example, if the lamp 11 is oriented, as shown, with the cathode 13 extending through the rear opening 21 in the reflector 12 and the anode 15 positioned to the front of the cathode 13, then the magnet 27 is oriented with the north-seeking or positive pole to the right and the south-seeking or negative pole to the left, when the reflector 12 is viewed from the rear as in FIG. 2. If the lamp 11 is reversed, it will be appreciated that a change in the direction in which the current flows will require reversing the orientation of the north-seeking pole and the south-seeking pole of the magnet 27. It will also be appreciated that the magnet 27 may be located at other positions on the reflector 12. For example, the magnet 27 may be located on the reflector 12 below the lamp 11 rather than above the lamp 11, as shown. However, it has been found easier to manufacture the reflector-magnet assembly with the magnet above the lamp 11 since the curvature of the reflector 12 is such that the magnet 27 will remain in place on the reflector 12 while the bonding agent hardens.

It has been found that the actual location and strength of the magnet 27 are not of an extremely critical nature. Once the strength, location and polarity of the magnet 27 is determined, lamphouses may be mass produced with the magnet 27 attached in the general area intially located, as long as the polarity is correct.

Through the use of the permanent magnet 27 attached to the paramagnetic reflector 12, sufficient stabilization of the fireball 18 and the plasma 19 is achieved to permit operation of the lamp 11 at any current levels, even levels considerably below the rated level for the lamp 11. For example, the lamp 11 may be operated as low as 25% or less of the rated current level without danger of explosion caused be instability of the plasma 19. Without the magnet 27, it is normally dangerous to operate the lamp 11 below about 80% of the rated current. If the operating current drops to about 50% or less of the rated current, there is an extremely high danger that the lamp 11 will explode due to instability of the plasma 19 causing a hot spot in the envelope 20 above the fireball 18. Through the use of magnetic stabilization in accordance with the present invention, the lamp 11 may be operated at lower current levels which increase the life of the lamp 11. In view of the high cost of lamps of this type, an increase in the operating life of the lamp is of considerable commercial value.

It will be appreciated that various modifications and changes may be made in the above-described embodiment of a lamphousing with a magnetically stabilized arc lamp without departing from the spirit and the scope of the claimed invention. For example, it will be appreciated that although the lamp 11 is shown with the cathode 13 extending through the reflector 12, the lamp 11 may be reversed with the anode 15 extending through the reflector 12. With such a change, the polarity of the stabilizing magnet 27 is reversed. Or, the magnet 27 may be located at positions other than that shown in the drawings, as long as the magnetic pole orientation and the magnetic field are such that the plasma 19 around the fireball 18 is stabilized. It will also be appreciated that various other construction features of the lamphousing are not critical to the present invention.

What I claim is:

1. In a lamphousing, an improved light source comprising an arc lamp having horizontally oriented electrodes, a thin-walled light reflector formed from a paramagnetic material, said reflector having an exterior surface and an interior light reflecting surface for reflecting light emitted from said arc lamp, at least one permanent magnet, and means attaching said magnet at a predetermined point and with a predetermined pole orientation to said exterior reflector surface as to magnetize a portion of said reflector to establish a magnetic field within said reflector which stabilizes the arc in said arc lamp.

2. An improved light source for a light projector, as set forth in claim 1, wherein said arc lamp is a high-pressure short-arc xenon lamp.

3. An improved light source for a light projector, as set forth in claim 1, wherein said reflector is formed from nickel.

4. An improved light source for a light projector, as set forth in claim 3, wherein said interior light reflecting surface is coated with a non-magnetic light reflecting material.

5. An improved light source for a light projector, as set forth in claim 3, wherein said magnet attaching means comprises a cured epoxy resin bonding said magnet to said exterior reflector surface at the predetermined point.

* * * * *